US007835652B2

(12) United States Patent
Konishi et al.

(10) Patent No.: US 7,835,652 B2
(45) Date of Patent: Nov. 16, 2010

(54) IMAGE DEVELOPING METHOD, IMAGE DEVELOPING DEVICE, AND IMAGE FORMING DEVICE

(75) Inventors: Rumi Konishi, Osaka (JP); Shuuichi Nakagawa, Osaka (JP); Ryuji Inoue, Hyogo (JP); Shin Murayama, Hyogo (JP); Kazushige Oonishi, Tokyo (JP); Shintaro Yamada, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 381 days.

(21) Appl. No.: 12/110,659

(22) Filed: Apr. 28, 2008

(65) Prior Publication Data

US 2008/0280225 A1 Nov. 13, 2008

(30) Foreign Application Priority Data

May 11, 2007 (JP) ..... 2007-126834

(51) Int. Cl.
*G03G 15/08* (2006.01)
*G03G 21/00* (2006.01)

(52) U.S. Cl. ..... 399/27; 399/127

(58) Field of Classification Search ..... 399/27, 399/29, 30, 234, 235, 148, 149, 127, 283, 399/273

See application file for complete search history.

(56) References Cited

U.S. PATENT DOCUMENTS

| | | | | |
|---|---|---|---|---|
| 5,214,475 | A * | 5/1993 | Ishii et al. | 399/27 |
| 2006/0280529 | A1 | 12/2006 | Nakagawa et al. | |
| 2007/0104523 | A1 | 5/2007 | Yoshida et al. | |
| 2007/0189812 | A1 | 8/2007 | Murayama et al. | |
| 2008/0075480 | A1 | 3/2008 | Konishi et al. | |

FOREIGN PATENT DOCUMENTS

| | | |
|---|---|---|
| JP | 9-258553 | 10/1997 |
| JP | 3029648 | 2/2000 |

* cited by examiner

*Primary Examiner*—Susan S Lee
(74) *Attorney, Agent, or Firm*—Oblon, Spivak, McClelland, Maier & Neustadt, L.L.P.

(57) ABSTRACT

An image developing method is disclosed that is able to efficiently remove degraded toner on a developing agent carrier, prevent formation of abnormal images, ensure good image quality over time, and increase the service life of the device. The developing method includes a step of calculating an amount of consumption of the developing agent during image formation and an amount of consumption of the developing agent in a compulsory toner consumption mode under different calculation conditions between the image formation and the compulsory toner consumption mode. In the compulsory toner consumption mode, a developing bias different from a developing bias used during image formation is applied for a predetermined time period to discharge residual developing agent on a developing agent carrier to a latent image carrier.

20 Claims, 3 Drawing Sheets

IMAGE DEVELOPING METHOD, IMAGE DEVELOPING DEVICE, AND IMAGE FORMING DEVICE

BACKGROUND OF THE INVENTION

1. Field of the Invention

The present invention relates to an image developing method used in an electrophotographic image forming device and for developing, by using a developing agent, a latent image on a latent image carrier, an image developing device using the image developing method, and an image forming device having the image developing device.

2. Description of the Related Art

In an electrophotographic image forming device of the related art, image data are optically recorded on a latent image carrier (for example, a photo-conductive object, below, referred to as a "photoconductor"), which is uniformly charged in advance, and an electrostatic latent image is obtained by exposure of reflected light from a manuscript, or by writing with a light writing device; the electrostatic latent image is converted into a visible image by toner (a toner image), which serves as a developing agent and is provided from a developing agent carrier (such as a developing roller) of a developing device. The visible toner image is transferred to a transferring member, such as a transfer sheet, and is fused on the transfer sheet, thereby forming an image as desired. In addition, in order to remove toner remaining on the photoconductor after image transfer, a cleaning unit is provided on a downstream side of the image transfer position.

Developing methods used by the developing device in the image forming device include single-component developing in which only the toner is used as the developing agent, and two-component developing in which the toner and magnetic carriers are used as the developing agent. In an image forming device of the related art having a developing device using single-component developing, the toner on the developing agent carrier (a developing roller) may form a film over time. Below, formation of a toner film is referred to as "toner filming". When toner filming occurs, charging characteristics of the toner become unstable, and this causes stains on the background, reduction in density of an image, or other abnormal images. Specifically, toner filming on the surface of the developing roller indicates that because a film-like toner layer covers the surface of the developing roller, it becomes difficult to charge the toner with the surface of the developing roller, and this makes the charging characteristics of the toner becomes unstable.

The mechanism of occurrence of the toner filming is as below.

When only a part of a toner-carrying width of the developing roller, is used for continuous image formation, for example, when the right half of an image is white, the toner in the region outside of the image forming portion (below, the region out of the image forming portion is referred to as "non-image portion") has nothing to do with developing in a series of developing operations, and merely adheres to the surface of the developing roller by the Coulomb force. In addition, since an end of a regulating blade, which is used for regulating the thickness of the toner on the surface of the developing roller to make the toner layer thin, is arranged to slidably contact the surface of the developing roller, the toner adhering to the non-image portion of the developing roller is repeatedly pressed by the regulating blade against the surface of the developing roller once the regulating blade passes through. Due to the pressure of the regulating blade, part of the toner consistently adheres to the surface of the developing roller and is pressed by the regulating blade many times. Note that some of the toner is scraped off the developing roller by the pressure of the regulating blade, and some toner newly adheres to the surface of the developing roller to be repeatedly pressed by the regulating blade.

In this way, when the toner, which continuously adheres to the surface of the developing roller and is pressed by the regulating blade many times, receives the pressure from the regulating blade, due to the heat generated by the pressure, the toner becomes film-like and can easily adhere to the surface of the developing roller. Such toner adhering to the surface of the developing roller further repeatedly receives the pressure from the regulating blade; thus, the amount of charge of the adhering toner increases, and thereby, it becomes more and more difficult for the adhering toner to be separated from the surface of the developing roller.

In the phenomenon called toner filming, the toner adhering to the non-image portion of the developing roller is repeatedly pressed by the regulating blade, cannot be separated from the surface of the developing roller, and thus forms a toner film.

The same problem occurs in an image forming device having a developing device using two-component developing.

Further, due to stirring by a toner conveyance member and a stirring member in the developing device, an additive agent, which is added in the developing agent to improve fluidity, may be berried in the toner, or be striped, and this degrades the charging characteristics of the toner.

For example, Japanese Laid Open Patent Application No. 9-258553 (hereinafter, referred to as "reference 1") discloses a technique for preventing toner filming on the developing roller. This technique includes performing a flash operation to remove the toner on the developing agent carrier by moving the toner on the developing agent carrier to the latent image carrier; because of the flash operation, the toner on the developing agent carrier is moved to the latent image carrier, and is used or is returned to the developing device.

In addition, Japanese Patent Gazette No. 3029648 (hereinafter, referred to as "reference 2") discloses a technique in which a printing rate is calculated for each manuscript; when the printing rate is less than a certain value, a checked pattern of the developing agent having a size corresponding to the ratio of the printing rate is formed before the next image formation operation, thus compulsively consuming the developing agent.

In the technique disclosed in reference 1, in order to prevent reduction of toner yield, as described above, the flash operation is performed to recycle the removed toner. However, by the technique disclosed in reference 1, it is difficult to prevent degradation of toner caused by mechanical stress in such as stirring, developing, and recollection operations, and toner recycling may cause degradation of image quality. Further, considering color copying, in the technique disclosed in reference 1, it is supposed that the flash operation is performed between two pieces of paper printed consecutively; however, because it is necessary to perform reverse transfer from the transfer unit for color mixing in a color copier, it is difficult to apply the technique disclosed in reference 1 to a color copier.

In addition, for purposes of maintenance, such as toner filling up, it is required to show users the amount of residual toner or the consumed toner. Generally, an optical sensor is provided in a toner container to detect the amount of the residual toner. However, in a color copier, it is necessary to provide a sensor for each color, and thus the number of parts rises, the cost of the device increases; and it is difficult to reduce the size of the device.

SUMMARY OF THE INVENTION

The present invention may solve one or more problems of the related art.

A preferred embodiment of the present invention may provide an image developing method and an image developing device able to efficiently remove degraded toner on a developing agent carrier, prevent formation of abnormal images, ensure good image quality over time, and increase the service life of the device. In addition the image developing method and the image developing device may involve a residual toner detector of low cost thus is capable of precise residual toner detection. In addition, an image forming device having the image developing device may be provided.

According to a first aspect of the present invention, there is provided a developing method of an image forming device for developing a latent image on a rotating latent image carrier by using a developing agent provided from a developing agent carrier, the method comprising a step of:

calculating, by using a toner consumption calculation unit and a compulsory toner consumption mode execution unit for executing a compulsory toner consumption mode, an amount of consumption of the developing agent during image formation and an amount of consumption of the developing agent in the compulsory toner consumption mode under different calculation conditions between the image formation and the compulsory toner consumption mode; in said compulsory toner consumption mode, a developing bias different from a developing bias used during image formation is applied for a predetermined time period to discharge residual developing agent on the developing agent carrier to the latent image carrier.

Preferably, an absolute value of a difference between a latent image potential and a developing bias used in the compulsory toner consumption mode is greater than an absolute value of a difference between a latent image potential and a developing bias used during the image formation.

Preferably, a developing bias used in the compulsory toner consumption mode is controlled, by using a detection unit and a correlation calculation unit, such that an amount of the residual developing agent per unit area discharged to the latent image carrier is equal to a predetermined target value, said detection unit being configured to detect a developing agent adhesion amount of a plurality of test patches formed on the latent image carrier by changing the developing bias, said correlation calculation unit being configured to calculate a correlation between the developing agent adhesion amount of the test patches and the developing bias.

Preferably, the target value of the amount of the residual developing agent per unit area discharged to the latent image carrier in the compulsory toner consumption mode changes along with a usage environment of the image forming device, said usage environment of the image forming device being determined by a usage environment determination unit.

Preferably, an amount of the residual developing agent discharged per unit time to the latent image carrier in the compulsory toner consumption mode is stored in advance; and the amount of consumption of the developing agent in the compulsory toner consumption mode is calculated to be equal to a product of an amount of the residual developing agent discharged per unit time and execution time of the compulsory toner consumption mode.

Preferably, the amount of consumption of the developing agent is calculated according to exposure data of an image to be formed on the latent image carrier;

a ratio of an amount of the developing agent per unit area for developing on the latent image carrier during the image formation and an amount of the developing agent per unit area in the compulsory toner consumption mode is stored in advance;

the amount of consumption of the developing agent during image formation is determined to be equal to the amount of consumption of the developing agent calculated according to the exposure data; and the amount of consumption of the developing agent in the compulsory toner consumption mode is determined to be equal to a product of the amount of consumption of the developing agent calculated according to the exposure data and the ratio of the amount of the developing agent per unit area on the latent image carrier during the image formation and an amount of the developing agent per unit area in the compulsory toner consumption mode.

Preferably, the compulsory toner consumption mode is executed at a time when a driving time of a developing device from a last operation is greater than or equal to a predetermined value, and the amount of consumption of the developing agent from the last operation is less than or equal to a predetermined value.

Preferably, an execution time period of the compulsory toner consumption mode is adjusted according to the amount of consumption of the developing agent from the last operation.

Preferably, the execution time period of the compulsory toner consumption mode is greater than or equal to a rotation period of the developing agent carrier.

According to a second aspect of the present invention, there is provided a developing device for developing a latent image on a rotating latent image carrier by using a developing agent, comprising:

a developing agent carrier configured to provide the developing agent carrier;

a toner consumption calculation unit configured to calculate an amount of consumption of the developing agent; and a compulsory toner consumption mode execution unit configured to execute a compulsory toner consumption mode, in which compulsory toner consumption mode a developing bias different from a developing bias used during image formation is applied for a predetermined time period to discharge residual developing agent on the developing agent carrier to the latent image carrier, wherein the toner consumption calculation unit and the compulsory toner consumption mode execution unit calculate the amount of consumption of the developing agent during the image formation and the amount of consumption of the developing agent in the compulsory toner consumption mode under different calculation conditions between the image formation and the compulsory toner consumption mode.

Preferably, an absolute value of a difference between a latent image potential and a developing bias used in the compulsory toner consumption mode is greater than an absolute value of a difference between a latent image potential and a developing bias used during the image formation.

Preferably, the developing device further comprises:

a detection unit configured to detect a developing agent adhesion amount of a plurality of test patches formed on the latent image carrier by changing the developing bias; and a correlation calculation unit configured to calculate a correlation between the developing agent adhesion amount of the test patches and the developing bias, wherein the detection unit and the correlation calculation unit control a developing bias used in the compulsory toner consumption mode such that an amount of the residual developing agent per unit area discharged to the latent image carrier is equal to a predetermined target value.

Preferably, the developing device further comprises:

a usage environment determination unit configured to determine a usage environment of an image forming device, wherein the target value of the amount of the residual developing agent per unit area discharged to the latent image carrier in the compulsory toner consumption mode changes is controlled to depend on the usage environment of the image forming device.

According to a third aspect of the present invention, there is provided an image forming device, comprising:

a latent image carrier that, while rotating, has a latent image formed thereon, and a developing unit that develops a latent image on the latent image carrier by using a developing agent, wherein the developing unit includes a developing agent carrier configured to provide the developing agent carrier;

a toner consumption calculation unit configured to calculate an amount of consumption of the developing agent; and a compulsory toner consumption mode execution unit configured to execute a compulsory toner consumption mode in which a developing bias different from a developing bias used during image formation is applied for a predetermined time period to discharge residual developing agent on the developing agent carrier to the latent image carrier, wherein the toner consumption calculation unit and the compulsory toner consumption mode execution unit calculate the amount of consumption of the developing agent during the image formation and the amount of consumption of the developing agent in the compulsory toner consumption mode under different calculation conditions between the image formation and the compulsory toner consumption mode.

Preferably, the image formation device further comprises:

a transfer unit that transfers an image formed on the latent image carrier to a target transfer object;

a cleaning unit that removes and collects the developing agent on the latent image carrier;

a toner collection calculation unit that calculates the amount of the toner removed and collected by the cleaning unit; and a second compulsory toner consumption mode execution unit configured to execute a second compulsory toner consumption mode in which a developing bias different from the developing bias used during image formation is applied for the predetermined time period to discharge the residual developing agent on the developing agent carrier to the latent image carrier, and the developing agent on the latent image carrier is removed by the cleaning unit without being transferred to the transfer unit, wherein the toner consumption calculation unit and the second compulsory toner consumption mode execution unit calculate the amount of the developing agent removed and collected by the cleaning unit during the image formation and in the second compulsory toner consumption mode under different calculation conditions between the image formation and the second compulsory toner consumption mode.

According to the above embodiments of the present invention, an amount of consumption of the developing agent during image formation and an amount of consumption of the developing agent in the compulsory toner consumption mode are calculated under different calculation conditions by using a toner consumption calculation unit and a compulsory toner consumption mode execution unit for executing a compulsory toner consumption mode in which a developing bias different from a developing bias used during image formation is applied for a predetermined time period to discharge residual developing agent on the developing agent carrier to the latent image carrier.

Therefore, as the developing bias used in the compulsory toner consumption mode is different from the developing bias used during image formation, and the amounts of consumption of the developing agent in different modes are precisely calculated under different calculation conditions, even when a toner end sensor is not provided, it is possible to remove degraded toner, maintain good image quality, and inform users of toner shortage at precise timings, thus resulting in cost reduction.

Therefore, according to the present invention, it is possible to efficiently remove degraded toner on a developing agent carrier, prevent formation of an abnormal image, ensure good image quality over time, increase the service life of the device, and to provide a residual toner detector of low cost and capable of precise residual toner detection.

These and other objects, features, and advantages of the present invention will become more apparent from the following detailed description of preferred embodiments given with reference to the accompanying drawings.

DESCRIPTION OF THE PREFERRED EMBODIMENTS

Figure 1:
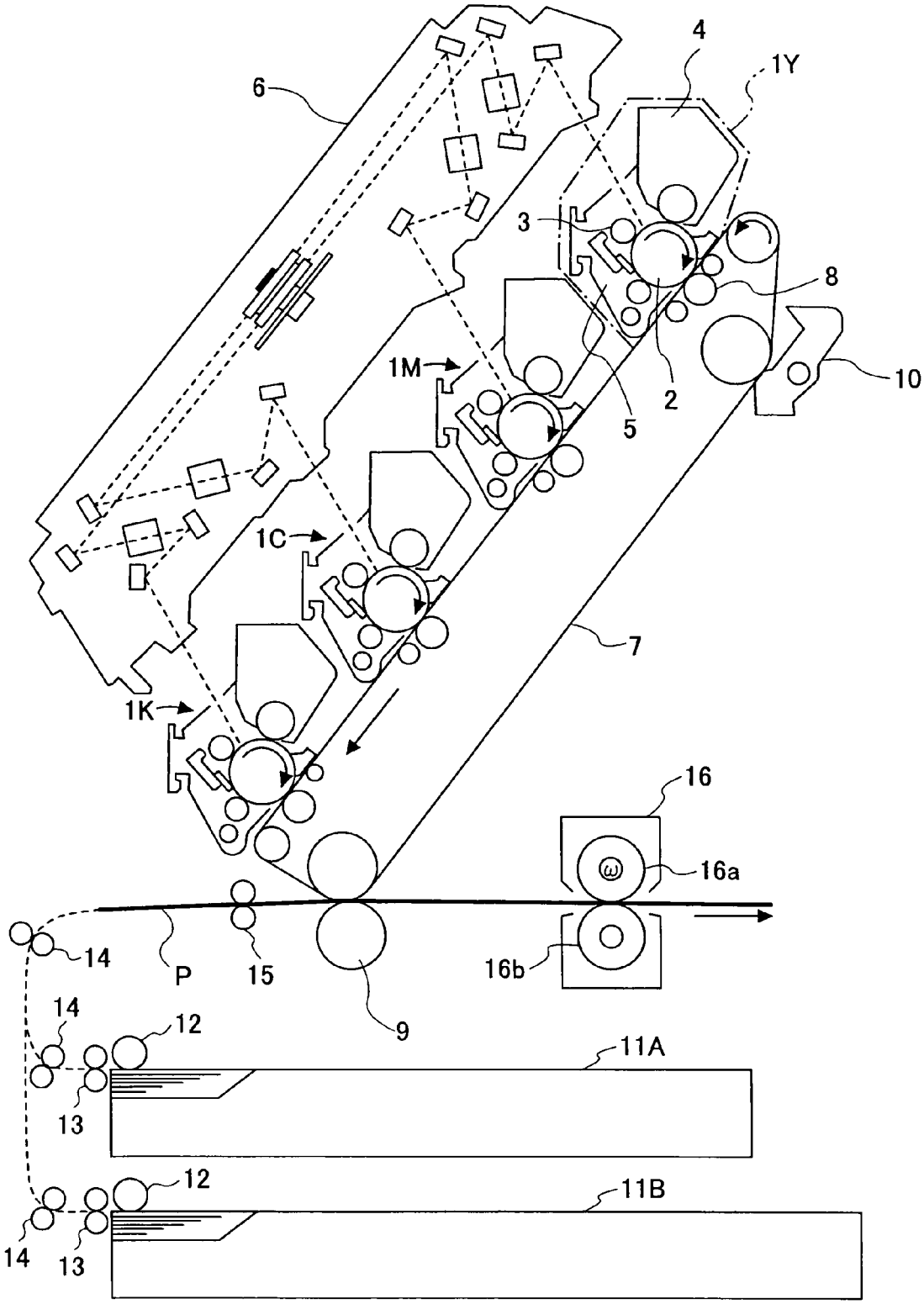
FIG. 1 is schematic cut-open view illustrating a principal portion of a tandem image forming device including plural image forming units according to an embodiment of the present invention.

Below, preferred embodiments of the present invention are explained with reference to the accompanying drawings.

As described above, because of various mechanical stresses in a developing device, charging characteristics of the toner are degraded over time. The mechanical stresses include friction with a film-thickness regulating blade or a developing agent supplying roller, or conveyance or stirring of toner in the developing device. When the charging characteristics of the toner are degraded, the residual toner on a developing agent carrier (such as a developing roller) is charged to have reverse conductivity, and adheres to a non-image portion of a latent image carrier (for example, a photoconductor); this causes stains on the background of an image, or reduction in image density since there is not a sufficient amount of toner adhering to the latent image.

In order to prevent image quality degradation caused by toner degradation, a compulsory toner consumption mode may be executed in which an appropriate developing bias is applied to compulsively discharge the degraded residual developing agent on the developing roller to the photoconductor.

When executing the compulsory toner consumption mode, for convenience of maintenance, such as toner filling-up, it is required to show users the amount of residual toner or the consumed toner. For this purpose, it is necessary to detect the amount of the toner consumed during image formation operations or in the compulsory toner consumption mode.

To solve the above problems, in the developing method of the present invention, a toner consumption calculation unit and a compulsory toner consumption mode execution unit are used to calculate an amount of consumption of the developing agent during image formation and an amount of consumption of the developing agent in the compulsory toner consumption mode under different calculation conditions, and in the compulsory toner consumption mode, a developing bias different from a developing bias used during image formation is applied for a certain time period to discharge the residual developing agent on the developing roller to the photoconductor.

That is, in the present invention, as the developing bias used in the compulsory toner consumption mode is different from the developing bias used during image formation, and the amount of consumption of the developing agent in different modes are precisely calculated under different calculation conditions, even when a toner end sensor is not provided, it is possible to remove degraded toner, maintain good image quality, and inform users of toner shortage at precise timings, thus resulting in cost reduction.

Preferably, in the developing method of the present invention, an absolute value of a difference between a latent image potential VL and a developing bias Vb in the compulsory toner consumption mode is greater than an absolute value of a difference between a latent image potential VL and a developing bias Vb during the image formation.

Therefore, since the difference between the latent image potential VL and the developing bias Vb in the compulsory toner consumption mode is greater than the difference between the latent image potential VL and the developing bias Vb during the usual image formation, the degraded toner which cannot be removed by the usual developing bias can be removed from the developing roller, and thus it is possible to prevent occurrence of abnormal images. As a result, it is possible to prevent stains on image background, and prevent toner filming on the developing roller, and hence increase the service life of the developing device.

In addition, in the present invention, a detection unit, which detects a developing agent adhesion amount of a plurality of test patches formed on the latent image carrier by changing the developing bias, and a correlation calculation unit, which calculates a correlation between the developing agent adhesion amount of the test patches and the developing bias, are used to control the developing bias used in the compulsory toner consumption mode such that the amount of the residual developing agent per unit area discharged to the photoconductor is equal to a specified target value.

For example, the detection unit may be an optical density sensor; the correlation calculation unit may be a CPU (Central Processing Unit) of a controller; and the specified target value may be stored beforehand in a memory of a controller or other devices.

Therefore, it is possible to efficiently remove the degraded toner on the developing roller. In addition, since the lower limit of the compulsory toner consumption amount per unit area required for preventing degradation of image quality is determined through experiments in advance, it is possible to reduce the compulsory toner consumption amount to a lower limit, thus ensure the toner yield.

In addition, in the present invention, the target value of the amount of the residual developing agent per unit area discharged to the photoconductor in the compulsory toner consumption mode changes along with the usage environment of the image forming device, and the usage environment of the image forming device is determined by a usage environment determination unit.

The charge of the toner changes along with the environment, conveyance amount on the developing roller also changes, so, when the compulsory toner consumption amount (that is, the setting of the developing bias) is adjusted in response to the conveyance amount on the developing roller, it is possible to efficiently discharge the degraded toner to the photoconductor.

In addition, in the present invention, an amount of the residual developing agent discharged per unit time to the photoconductor in the compulsory toner consumption mode is stored in advance, and the amount of consumption of the developing agent in the compulsory toner consumption mode is calculated to be equal to a product of the amount of the residual developing agent discharged per unit time and execution time of the compulsory toner consumption mode.

Since the image pattern formed in the compulsory toner consumption mode is known in advance, when the toner consumption amount per unit area required in the compulsory toner consumption mode is determined through experiments in advance, it is possible to correctly determine the toner consumption amount in the compulsory toner consumption mode.

In addition, in the present invention, the amount D of consumption of the developing agent is calculated according to exposure data of an image to be formed on the photoconductor, a ratio $\alpha$ of an amount of the developing agent per unit area for developing on the photoconductor during the image formation and an amount of the developing agent per unit area in the compulsory toner consumption mode is stored beforehand in the memory of the controller. The amount of consumption of the developing agent during image formation is determined to be equal to D, and the amount of consumption of the developing agent in the compulsory toner consumption mode is determined to be equal to $\alpha D$.

Since the developing bias used in the compulsory toner consumption mode is different from the developing bias used during image formation, the toner consumption amount is different even when the area of a latent image is the same. As described above, by correcting the toner consumption amount, which is calculated in the same way as in the usual image formation, based on adhesion amount per unit area, it is possible to correctly calculate the toner consumption amount.

During the usual image formation, however, when the toner consumption amount of the image being formed is small, since the toner on the developing roller repeatedly receives the mechanical stress without being exchanged by other toner, this portion of toner is degraded strongly. In order to reduce the level of degradation of the toner so that the image quality is not influenced, when the toner consumption amount of the image being formed is small, it is necessary to eject the toner on the developing roller regularly to impede degradation of the toner.

Further, the toner is liable to be degraded when the toner consumption amount is small relative to a driving time of the developing device. For this reason, if the number of copies to be printed is used as a trigger, even when the same image is printed for the same number of copies, the driving time of the developing device is different between continuous printing mode and intermittent printing mode; the driving time of the developing device is long in the intermittent printing mode, and thus toner degradation is strong.

To solve this problem, in the present invention, the compulsory toner consumption mode is executed at a time when the driving time ΔT of the developing device from the last operation is greater than or equal to a specified value, and the accumulative amount Δm of consumption of the developing agent from the last operation is less than or equal to a specified value.

Since the trigger of executing the compulsory toner consumption mode is the driving time ΔT of the developing device, it is possible to deal with toner degradation level due to printing duty (the number of printing copies in one job).

Further, in the present invention, an execution time period Δt of the compulsory toner consumption mode is adjusted according to the amount of consumption of the developing agent from the last operation.

In order to prevent reduction of the toner yield as much as possible while remove the degraded toner on the developing roller, since when the toner consumption amount during image formation is small; the degraded toner may accumulate very much, the driving time of the compulsory toner consumption mode is lengthened to increase the amount of the amount of the ejected toner. On contrary, when the toner consumption amount during image formation is large, the amount of the accumulated degraded toner is small, thus, the driving time of the compulsory toner consumption mode is shortened (that is, the amount of the compulsory toner consumption is decreased).

In addition, in the present invention, the execution time period Δt of the compulsory toner consumption mode is greater than or equal to a rotation period Δt1 of the developing roller.

In order to completely remove the degraded toner remaining on the whole surface of the developing roller, it is necessary to execute the compulsory toner consumption mode over the whole surface of the developing roller, that is, to cover at least the circumferential length of the developing roller. In addition, since the toner film on the developing roller formed by toner filming can hardly be removed, it is preferable to apply a high developing bias to execute the compulsory toner consumption mode to cover one or more circumferential lengths of the developing roller.

In addition, an image forming device in the present invention includes a photoconductor that, while rotating, has a latent image formed thereon, a developing unit that develops a latent image on the photoconductor by using a developing agent. The developing unit includes a developing agent carrier for providing the developing agent, a toner consumption calculation unit for calculating an amount of consumption of the developing agent, and a compulsory toner consumption mode execution unit for executing the compulsory toner consumption mode. The toner consumption calculation unit and the compulsory toner consumption mode execution unit calculate the amount of consumption of the developing agent during the image formation and the amount of consumption of the developing agent in the compulsory toner consumption mode under different calculation conditions between the image formation and the compulsory toner consumption mode.

Alternatively, the image formation device further includes a transfer unit for transferring an image formed on the photoconductor to a target transfer object, a cleaning unit for removing and collecting the developing agent on the photoconductor, a toner collection calculation unit for calculating the amount of the toner removed and collected by the cleaning unit, and a second compulsory toner consumption mode execution unit for executing a second compulsory toner consumption mode. In the second compulsory toner consumption mode, a developing bias different from the developing bias used during image formation is applied for the predetermined time period to discharge the residual developing agent on the developing agent carrier to the photoconductor, and the developing agent on the photoconductor is removed by the cleaning unit without being transferred to the transfer unit. The toner consumption calculation unit and the second compulsory toner consumption mode execution unit calculate the amount of the developing agent removed and collected by the cleaning unit during the image formation and in the second compulsory toner consumption mode under different calculation conditions between the image formation and the second compulsory toner consumption mode.

For example, the target transfer object is a transfer sheet like transfer paper, or an intermediate transfer unit.

The amount of the waste toner collected by the cleaning unit during the image formation is largely different that in the compulsory toner consumption mode, in which transfer is not performed. Because different calculation conditions are used during the usual image formation and in the compulsory toner consumption mode, it is possible to correctly calculate the amount of the collected toner, and even when a waste toner end sensor is not provided, it is possible to send information, at correct timings, to a user to urge him to exchange the toner, and thus resulting in cost reduction.

Below, specific configurations, operations, and advantages of preferred embodiments of the present invention are explained in detail with reference to the accompanying drawings.

FIG. 1 is schematic cut-open view illustrating a principal portion of a tandem image forming device including plural image forming units according to an embodiment of the present invention.

In the image forming device shown in FIG. 1 includes four image forming units 1Y, 1M, 1C, 1K which have different developing colors, such as yellow (Y), magenta (M), cyan (C), and black (K), and the four image forming units 1Y, 1M, 1C, 1K are process cartridges having the same structure.

Each of the process cartridges 1Y, 1M, 1C, 1K includes a photoconductive drum 2, a charging roller 3, a developer 4, and a cleaner 5, which are integrated together. Each of the process cartridges 1Y, 1M, 1C, 1K is detachably attached to the image forming device shown in FIG. 1, and can be exchanged by releasing a stopper thereof.

The photoconductive drum 2 in each of the process cartridges 1Y, 1M, 1C, 1K rotates in a direction indicated by an arrow in FIG. 1 at a rotational speed (surface linear speed) of 150 mm/sec.

The charging roller 3, serving as charging means, is pressed against the surface of the photoconductive drum 2, and is driven to rotate by the rotation of the photoconductive drum 2.

A given bias (a direct-current bias, or a bias with an alternating current superposed on a direct current) is applied on the charging roller 3 from a not-illustrated high voltage power supply to charge the surface of the charging roller 3 to −500 V.

It should be noted that the charging means is not limited to the charging roller 3, but can be a charging brush, a non-contacting charging device, etc.

An exposure device 6 is provided to emit a light beam onto the photoconductive drum 2 in response to input image data, thereby forming electrostatic latent images. For example, the exposure device 6 may be a laser beam scanner including a light source (such as a laser diode), a coupling optical system (such as an optical system including a coupling lens, an aperture, a cylindrical lens, and others), a light deflector, a scanning imaging optical system, and others.

The light source may be a laser diode. The coupling optical system may include a coupling lens, an aperture, a cylindrical lens, and others. The light deflector may be a polygon mirror, or a pyramidal mirror, or a vibrating mirror. The scanning imaging optical system may be an optical system including a constant speed scanning lens, such as an fθ lens, lenses for correcting aberration or image surface curvature, and mirrors.

In addition to the above examples, the exposure device 6 may also be a line-shaped light writing device including a light emission diode (LED) array and an imaging element array, such as a micro-lens array or a rod-lens array.

The developer 4 is a contacting developing device utilizing a single-component developing agent (toner). The developer 4 develops the electrostatic latent images on the photoconductive drum 2 by using the toner carried on a developing roller serving as a developing agent carrier to convert the electrostatic latent image into visible toner images.

A specified developing bias from a not-illustrated high voltage power supply is applied on the developing roller of the developer 4.

The photoconductor cleaner 5 is a cleaning device for removing residual toner staying on the surface of the photoconductive drum 2 with a cleaning blade, a Furry brush, or other cleaning members.

The process cartridges 1Y, 1M, 1C, 1K are arranged side by side in a movement direction (indicated by an arrow in FIG. 1) of an intermediate transfer belt 7 suspended on multiple rollers (driving rollers and driven rollers).

In each of the process cartridges 1Y, 1M, 1C, 1K in sequence the charging roller 3 charges the surface of the photoconductive drum 2, the exposure device 6 emits a light beam onto the photoconductive drum 2, and the developer 4 develops the electrostatic latent image on the photoconductive drum 2, thereby obtaining visible toner images in order of yellow (Y), magenta (M), cyan (C), and black (K).

A first transfer roller 8 is provided on the back side of the intermediate transfer belt 7 and at a position facing each of the photoconductive drums 2 of the process cartridges 1Y, 1M, 1C, 1K. From a not-illustrated high voltage power supply, a certain first transfer bias is applied on the first transfer rollers 8 so that toner images on the surfaces of the photoconductive drums 2 are sequentially transferred to and superposed on the surface of the intermediate transfer belt 7. The intermediate transfer belt 7 is driven by a not-illustrated driving motor to rotate in a direction indicated by an arrow in FIG. 1. When the toner images of different colors are sequentially transferred to and superposed on the surface of the intermediate transfer belt 7, a full color image is obtained.

A paper supplier portion for supplying transfer paper is provided on the lower portion of the main body of the image forming device in FIG. 1, and the paper supplier portion includes a paper cassette 11A and a paper cassette 11B for accommodating transfer paper P of different sizes. A not-illustrated operational panel is operated to select a given paper size, and from one of the paper cassette 11A and the paper cassette 11B for transfer paper P of the given paper size, the transfer paper P is fed one by one by a paper feeding roller 12 and a separation roller 13, and is conveyed to a register roller 15 through a conveyance roller 14. Then, the transfer paper P is fed to the nip between the intermediate transfer belt 7 and a second transfer roller 9 by the register roller 15 at timings in agreement with the first transfer to the intermediate transfer belt 7.

A certain second transfer bias is applied on the second transfer roller 9 from a not-illustrated high voltage power supply; thereby, the full color image formed on the intermediate transfer belt 7 is transferred to the transfer paper P.

The full color image transferred to the transfer paper P is heated at the nip between a heating roller 16*a* and a heating roller 16*b* of a fuser 16, and thus the full color image is fused on the transfer paper P. The transfer paper P with the full color image thereon is output to a not-illustrated delivery tray or other post-processing devices. Note that the residual toner remaining on the intermediate transfer belt 7, which failed to be transferred by the second transfer roller 9 is collected by an intermediate transfer belt cleaner 10.

In the full-color image forming device shown in FIG. 1, a controller is provided to control operations of the above-mentioned components, and control image forming operations, or compulsory consumption mode operations as described below. Although not illustrated in FIG. 1, for example, the controller may include a microprocessor unit or other CPUs (Central Processing Unit); various memories like ROM (Read Only Memory), RAM (Randomly Access Memory), non-volatile RAM; input and output devices like I/O ports; various interfaces, kinds of control circuits, clocks, timers, counters, and so on. Control programs or data may be stored in the memory in advance. In addition, various kinds of sensors, such as a temperature sensor, a humidity sensor, a density sensor, and a paper detection sensor are provided on the above-mentioned components of the full-color image forming device shown in FIG. 1, and detection information from these sensors is input to the controller. The controller performs control based on the detection information from the sensors.

Figure 2:
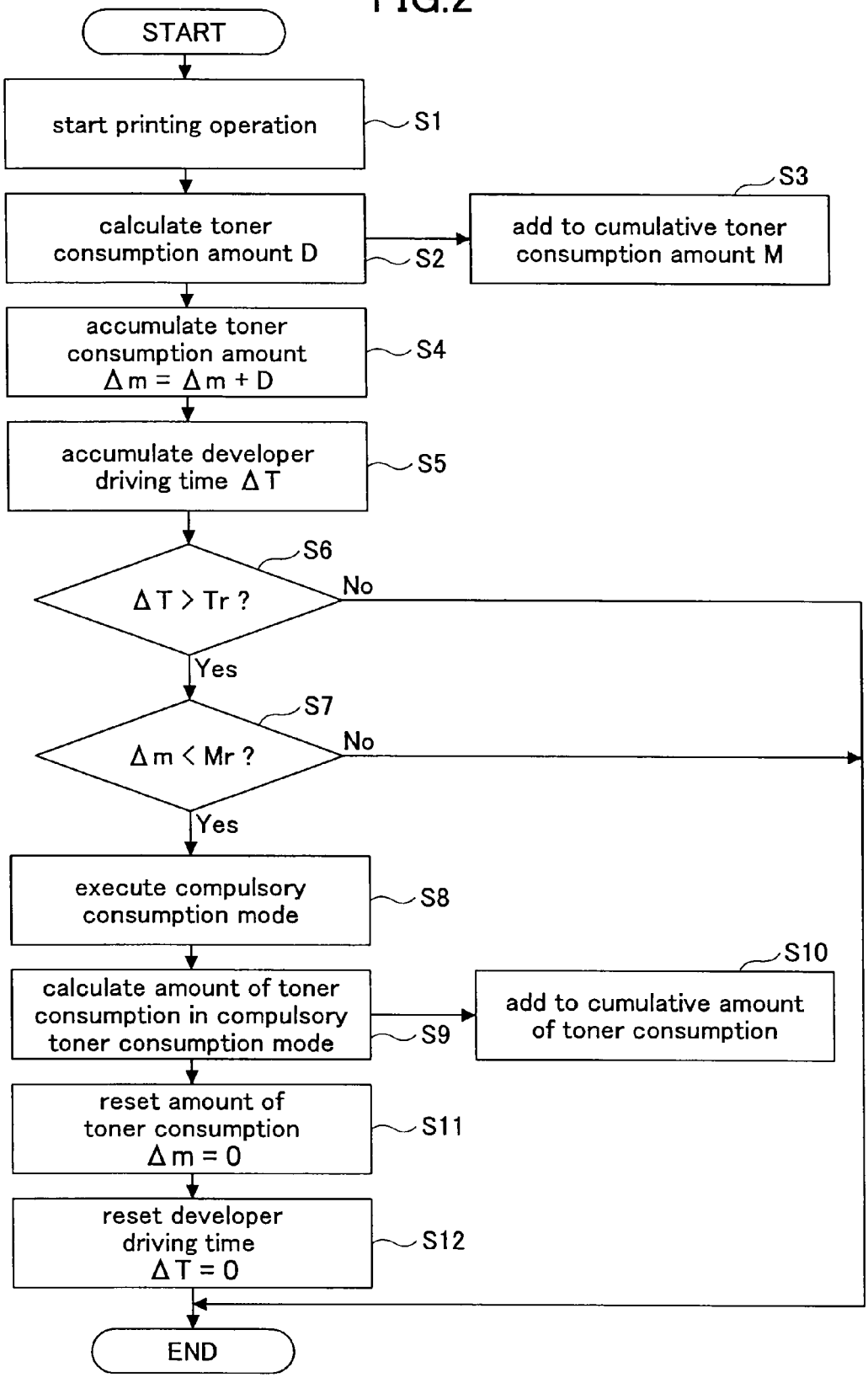
FIG. 2 is a flow chart exemplifying compulsory consumption mode operations in the developing device and the image forming device according to the present embodiment of the present invention.

FIG. 2 is a flowchart exemplifying compulsory consumption mode operations in the developing device and the image forming device according to the present embodiment of the present invention.

Programs and control data used for executing the compulsory consumption mode operation are stored in the memory of the not-illustrated controller, and the programs are executed by the CPU while using the control data. The CPU has functions of performing various kinds calculations, thus also serves as a consumption amount calculation device.

Note that although the operations shown in FIG. 2 are executed by the four image forming units 1Y, 1M, 1C, 1K, since the operations executed by the four image forming units (process cartridges) 1Y, 1M, 1C, 1K are the same, the operations shown in FIG. 2 are explained with any one of the four image forming units 1Y, 1M, 1C, 1K as an example.

In FIG. 2, in step S1, the image forming device starts printing operations.

In step S2, the CPU of the not-illustrated controller calculates toner consumption amount D for each page based on exposure data.

In step S3, the CPU-accumulates the toner consumption amount D in the toner consumption amount M from the time when the developer 4 starts to operate.

In step S4, the CPU accumulates the toner consumption amount D in the toner consumption amount Δm from the last compulsory consumption mode operation to obtain a cumulative toner consumption amount (Δm=Δm+D).

In step S5, when printing of one page is finished, the CPU calculates cumulative driving time (referred to as "developer driving time") ΔT of the developer 4 from the last compulsory consumption mode operation.

In step S6, the CPU compares the developer driving time ΔT with a threshold value Tr.

When ΔT is greater than the threshold value Tr, the routine proceeds to step S7; otherwise, when ΔT is less than or equal to the threshold value Tr, the routine is finished so as to allow printing of the next page.

In step S7, the CPU compares the cumulative toner consumption amount Δm with a certain threshold value Mr.

When Δm is less than the threshold value Mr, the routine proceeds to step S8; otherwise, when Δm is greater than or equal to the threshold value Mr, the routine is finished so as to allow printing of the next page.

In step S8, the CPU executes the compulsory consumption mode operations.

Execution of the compulsory consumption mode can be triggered page by page. However, when the printing rate of one page is less than a target value, if the compulsory consumption mode is executed page by page, the total toner consumption amount may be greater than a target value. In other words, the toner yield may decline significantly.

If the compulsory consumption mode is executed each time a number of pages are printed, since the driving time of the developer 4 for printing N pages strongly depends on the printing mode, for example, a continuous printing mode or an intermittent printing mode, even when printing the same image, the degradation level of the toner also changes along with the printing mode.

Figure 3:
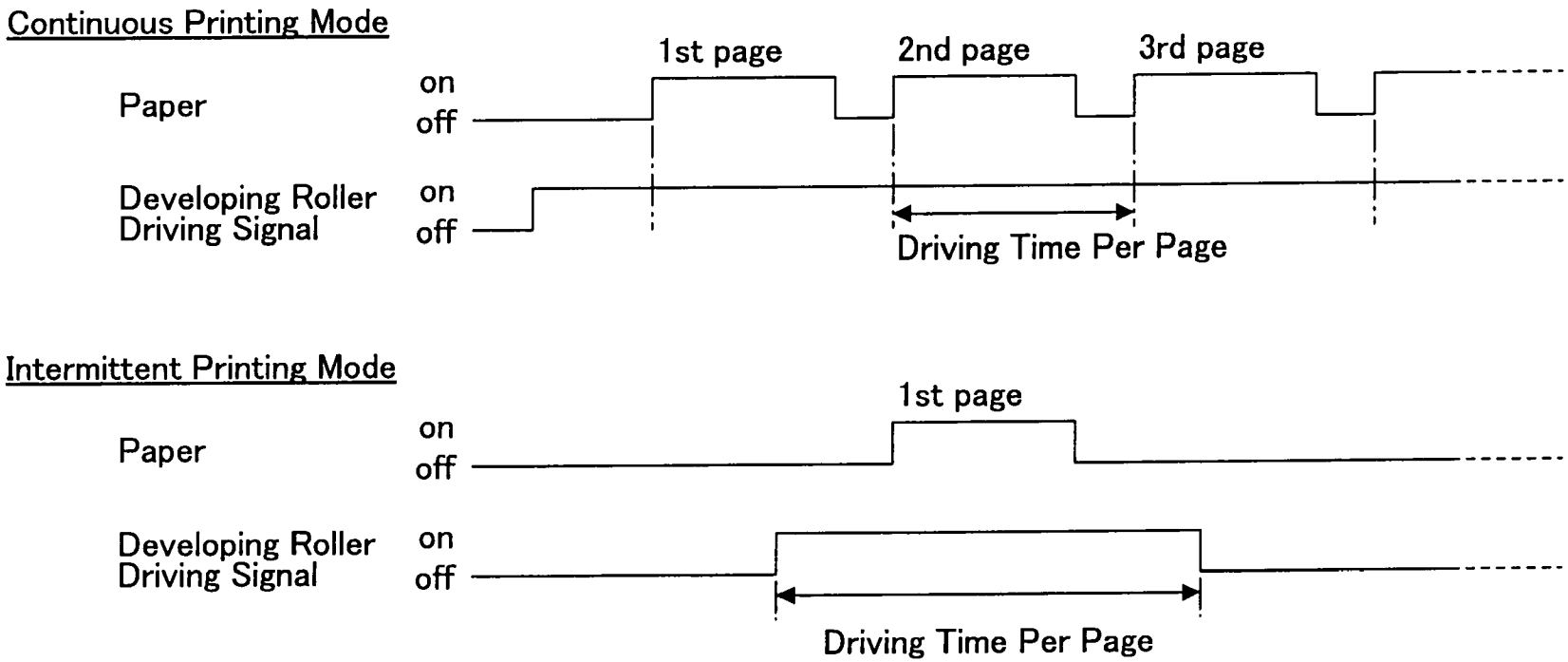
FIG. 3 is a timing chart illustrates driving states of the developing roller in the continuous printing mode and the intermittent printing mode.

FIG. 3 is a timing chart illustrating driving states of the developing roller in the continuous printing mode and the intermittent printing mode.

As shown in FIG. 3, the driving time of the developer 4 for printing N pages changes greatly depending on whether the printing mode is the continuous printing mode or the intermittent printing mode even when printing the same image.

Upon this, in the present embodiment, the driving time ΔT of the developer 4 is used as a trigger of executing the compulsory toner consumption mode, instead of the number of pages to be printed; due to this, it is possible to remove the degraded toner at optimum timings no matter which of the continuous printing mode and the intermittent printing mode is adopted.

In the present embodiment, assuming the usual developing bias during the image formation is represented by Vb, the developing bias for discharging the degraded toner on the developing roller in the compulsory toner consumption mode is represented by Vbr, and the potential of the latent image (image portion) on the photoconductive drum 2 is represented by VL, the usual developing bias Vb, the developing bias Vbr in the compulsory toner consumption mode, and the latent image potential VL satisfy the following relation.

$$|Vbr-VL|>|Vb-VL|$$

That is, the developing bias Vbr in the compulsory toner consumption mode is greater than the usual developing bias Vb in the image formation. As a result, the degraded toner which is hard to be separated from the developing roller by the usual developing bias in usual printing operations can be efficiently removed from the photoconductive drum, and thus it is possible to prevent toner filming on the developing roller and to maintain good quality. In addition, it is possible to prevent stains on image background, hence reduce toner consumption caused by the stains on image background, and this improves toner yield and increase the service life of the developing device.

In the image forming device according to the present embodiment, a number of test patches at different developing biases are formed on the photoconductive drum 2, a not illustrated optical density sensor having a light emission unit and a light receiving unit is provided to detect the density of each of the test patches, and the final developing bias is designated so that the amount of the developing agent per unit area on the photoconductive drum 2 equals a target value. Below, the amount of the developing agent per unit area on the photoconductive drum 2 is denoted to be M/A.

The target value of M/A in the compulsory toner consumption mode is set to be higher than the target value of M/A in usual printing operations, and Vb and Vbr are set in response to their target values, respectively. The target value of M/A in the compulsory toner consumption mode changes along with usage environment of the image forming device, such as temperature and humidity. When the temperature and the humidity change, charging characteristics of the toner change, toner conveyance amount on the developing roller also changes, and this causes a change of the appropriate level of the compulsory toner consumption mode required to sufficiently remove degraded toner.

In the present embodiment, the target value of M/A in the compulsory toner consumption mode is adjusted in response to the usage environment; thereby, it is possible to efficiently remove the degraded toner from the developing roller.

For example, Vb and Vbr can be set when changes of the temperature and the humidity of the usage environment of the image forming device are greater than a specified value, or when the process cartridges 1Y, 1M, 1C, 1K are exchanged.

It should be noted that although it is described above that the test patches are formed on the photoconductive drum 2, and the density of the test patches are read and detected, the present embodiment is not limited to this. For example, the test patches can be formed on the intermediate transfer belt 7.

In the present embodiment, an execution time period Δt of the compulsory toner consumption mode is adjusted according to the amount of toner consumption from the last compulsory toner consumption mode. Here, the amount of toner consumption from the last compulsory toner consumption mode is denoted to be Δm.

It is known that when the toner consumption amount during usual printing operations is smaller, much degraded toner remains on the developing roller. When the amount of toner consumption Δm is small, it is necessary to set the execution time period Δt of the compulsory toner consumption mode to be long to efficiently discharge the degraded toner. On the other hand, when the amount of toner consumption Δm is large, it is necessary to set the execution time period Δt of the compulsory toner consumption mode to be short to minimize reduction of the toner yield. However, in order to completely remove the remaining degraded toner adhering to the whole surface of the developing roller, it is necessary to execute the compulsory toner consumption mode over the whole surface of the developing roller, that is, to cover at least the circumferential length of the developing roller. In other words, it is necessary to set the execution time period Δt of the compulsory toner consumption mode to be greater than or equal to a rotation period Δt1 of the developing roller.

Returning to FIG. 2, in step S8, the compulsory toner consumption mode is executed.

In step S9, the CPU of the not illustrated controller calculates the amount of toner consumption in the compulsory toner consumption mode.

In the present embodiment, the amount of toner consumption in the compulsory toner consumption mode and the amount of toner consumption during image formation are calculated under different calculation conditions. Specifically, the amount of the toner consumption discharged per unit time in the compulsory toner consumption mode is stored in the memory of the controller in advance (below, the amount of the toner consumption discharged per unit time in the compulsory toner consumption mode is denoted to be mr), and the amount of toner consumption in the compulsory toner consumption mode is calculated to be equal to mr×Δt.

In step S10, the CPU adds the obtained amount of toner consumption in the compulsory toner consumption mode to the cumulative amount of toner consumption from the time when the developer 4 starts operations.

In step S11, after the compulsory toner consumption mode is executed, the amount of toner consumption is reset (that is, Δm=0).

In step S12, the driving time ΔT of the developer 4 is reset (that is, ΔT=0).

Then, the routine is completed.

In another embodiment of the present invention, the amount of toner consumption in the compulsory toner consumption mode can be calculated in the following way. First, just as in usual printing operations, the amount of toner consumption is calculated according to exposure data of given patterns, and then the thus obtained amount of toner consumption is multiplied by a ratio α of M/A on the photoconductor during the image formation and M/A in the compulsory toner consumption mode. For example, the ratio α can be stored beforehand in the memory of the controller.

Specifically, the CPU of the controller calculates the amount of developing agent consumption D according to exposure data of patterns formed on the photoconductor drum 2; a ratio α of the amount of the developing agent per unit area on the photoconductor 2 during the image formation (M/A) and the amount of the developing agent per unit area on the photoconductor 2 in the compulsory toner consumption mode (M/A) is stored beforehand in the memory of the controller; the CPU of the controller determines the amount of toner consumption in the compulsory toner consumption mode to be equal to αD.

In still another embodiment of the present invention, in the compulsory toner consumption mode, the toner discharged on the photoconductor drum 2 is not transferred to the intermediate transfer belt 7, but cleaned by the photoconductor cleaner 5.

The CPU of the controller calculates the amount of the waste toner removed and collected by the photoconductor cleaner 5; specifically, the CPU of the controller determines the amount of the waste toner collected by the photoconductor cleaner 5 during the usual image formation process to be the amount of toner consumption multiplied by (1-transfer efficiency), and determines the amount of the waste toner collected by the photoconductor cleaner 5 in the compulsory toner consumption mode to be the amount of toner consumption.

As a result, it is possible to correctly calculate the amount of the collected toner even when a waste toner sensor is not provided. Even without the waste toner sensor, it is possible to display information on a not-illustrated operational panel at correct timings to prompt a user to exchange the process cartridge, thus avoiding overflow of the waste toner from the cleaner 5 and resulting in cost reduction.

While the present invention is described with reference to specific embodiments chosen for purpose of illustration, it should be apparent that the invention is not limited to these embodiments, but numerous modifications could be made thereto by those skilled in the art without departing from the basic concept and scope of the invention.

This patent application is based on Japanese Priority Patent Application No. 2007-126834 filed on May 11, 2007, the entire contents of which are hereby incorporated by reference.

What is claimed is:

1. A developing method of an image forming device for developing a latent image on a rotating latent image carrier by using a developing agent provided from a developing agent carrier, the method comprising a step of:

calculating, by using a toner consumption calculation unit and a compulsory toner consumption mode execution unit for executing a compulsory toner consumption mode, an amount of consumption of the developing agent during image formation and an amount of consumption of the developing agent in the compulsory toner consumption mode under different calculation conditions between the image formation and the compulsory toner consumption mode, and in said compulsory toner consumption mode, a developing bias different from a developing bias used during image formation is applied for a predetermined time period to discharge residual developing agent on the developing agent carrier to the latent image carrier.

2. The developing method as claimed in claim 1, wherein an absolute value of a difference between a latent image potential and a developing bias used in the compulsory toner consumption mode is greater than an absolute value of a difference between a latent image potential and a developing bias used during the image formation.

3. The developing method as claimed in claim 1, wherein a developing bias used in the compulsory toner consumption mode is controlled, by using a detection unit and a correlation calculation unit, such that an amount of the residual developing agent per unit area discharged to the latent image carrier is equal to a predetermined target value, said detection unit being configured to detect a developing agent adhesion amount of a plurality of test patches formed on the latent image carrier by changing the developing bias, said correlation calculation unit being configured to calculate a correlation between the developing agent adhesion amount of the test patches and the developing bias.

4. The developing method as claimed in claim 3, wherein the target value of the amount of the residual developing agent per unit area discharged to the latent image carrier in the compulsory toner consumption mode changes along with a usage environment of the image forming device, said usage environment of the image forming device being determined by a usage environment determination unit.

5. The developing method as claimed in claim 1, wherein an amount of the residual developing agent discharged per unit time to the latent image carrier in the compulsory toner consumption mode is stored in advance; and the amount of consumption of the developing agent in the compulsory toner consumption mode is calculated to be equal to a product of an amount of the residual developing agent discharged per unit time and execution time of the compulsory toner consumption mode.

6. The developing method as claimed in claim 1, wherein the amount of consumption of the developing agent is calculated according to exposure data of an image to be formed on the latent image carrier;

a ratio of an amount of the developing agent per unit area for developing on the latent image carrier during the image formation and an amount of the developing agent per unit area in the compulsory toner consumption mode is stored in advance;

the amount of consumption of the developing agent during image formation is determined to be equal to the amount of consumption of the developing agent calculated according to the exposure data; and the amount of consumption of the developing agent in the compulsory toner consumption mode is determined to be equal to a product of the amount of consumption of the developing agent calculated according to the exposure data and the ratio of the amount of the developing agent per unit area on the latent image carrier during the image formation and the amount of the developing agent per unit area in the compulsory toner consumption mode.

7. The developing method as claimed in claim 1, wherein the compulsory toner consumption mode is executed at a time when a driving time of a developing device from a last operation is greater than or equal to a predetermined value, and the amount of consumption of the developing agent from the last operation is less than or equal to a predetermined value.

8. The developing method as claimed in claim 7, wherein an execution time period of the compulsory toner consumption mode is adjusted according to the amount of consumption of the developing agent from the last operation.

9. The developing method as claimed in claim 8, wherein the execution time period of the compulsory toner consumption mode is greater than or equal to a rotation period of the developing agent carrier.

10. A developing device for developing a latent image on a rotating latent image carrier by using a developing agent, comprising:

a developing agent carrier configured to provide the developing agent carrier;

a toner consumption calculation unit configured to calculate an amount of consumption of the developing agent; and a compulsory toner consumption mode execution unit configured to execute a compulsory toner consumption mode, and in said compulsory toner consumption mode, a developing bias different from a developing bias used during image formation is applied for a predetermined time period to discharge residual developing agent on the developing agent carrier to the latent image carrier, wherein the toner consumption calculation unit and the compulsory toner consumption mode execution unit calculate the amount of consumption of the developing agent during the image formation and the amount of consumption of the developing agent in the compulsory toner consumption mode under different calculation conditions between the image formation and the compulsory toner consumption mode.

11. The developing device as claimed in claim 10, wherein an absolute value of a difference between a latent image potential and a developing bias used in the compulsory toner consumption mode is greater than an absolute value of a difference between a latent image potential and a developing bias used during the image formation.

12. The developing device as claimed in claim 10, further comprising:

a detection unit configured to detect a developing agent adhesion amount of a plurality of test patches formed on the latent image carrier by changing the developing bias; and a correlation calculation unit configured to calculate a correlation between the developing agent adhesion amount of the test patches and the developing bias, wherein the detection unit and the correlation calculation unit control a developing bias used in the compulsory toner consumption mode such that an amount of the residual developing agent per unit area discharged to the latent image carrier is equal to a predetermined target value.

13. The developing device as claimed in claim 12, further comprising:

a usage environment determination unit configured to determine a usage environment of an image forming device, wherein the target value of the amount of the residual developing agent per unit area discharged to the latent image carrier in the compulsory toner consumption mode changes depending on the usage environment of the image forming device.

14. The developing device as claimed in claim 10, wherein an amount of the residual developing agent discharged per unit time to the latent image carrier in the compulsory toner consumption mode is stored in advance; and the amount of consumption of the developing agent in the compulsory toner consumption mode is calculated to be equal to a product of an amount of the residual developing agent discharged per unit time and execution time of the compulsory toner consumption mode.

15. The developing device as claimed in claim 10, wherein the amount of consumption of the developing agent during image formation is determined to be equal to the amount of consumption of the developing agent calculated according to exposure data of an image to be formed on the latent image carrier; and the amount of consumption of the developing agent in the compulsory toner consumption mode is determined to be equal to a product of the amount of consumption of the developing agent calculated according to the exposure data and a ratio of an amount of the developing agent per unit area for developing on the latent image carrier during the image formation and an amount of the developing agent per unit area in the compulsory toner consumption mode.

16. The developing device as claimed in claim 10, wherein the compulsory toner consumption mode is executed at a time when a driving time of a developing device from a last operation is greater than or equal to a predetermined value, and the amount of consumption of the developing agent from the last operation is less than or equal to a predetermined value.

17. The developing device as claimed in claim 16, wherein an execution time period of the compulsory toner consumption mode is adjusted according to the amount of consumption of the developing agent from the last operation.

18. The developing device as claimed in claim 17, wherein the execution time period of the compulsory toner consumption mode is greater than or equal to a rotation period of the developing agent carrier.

19. An image forming device, comprising:

a latent image carrier that, while rotating, has a latent image formed thereon, and a developing unit that develops the latent image on the latent image carrier by using a developing agent, wherein the developing unit includes a developing agent carrier configured to provide the developing agent carrier;

a toner consumption calculation unit configured to calculate an amount of consumption of the developing agent; and a compulsory toner consumption mode execution unit configured to execute a compulsory toner consumption mode in which a developing bias different from a developing bias used during image formation is applied for a predetermined time period to discharge residual developing agent on the developing agent carrier to the latent image carrier, wherein the toner consumption calculation unit and the compulsory toner consumption mode execution unit calculate the amount of consumption of the developing agent during the image formation and the amount of consumption of the developing agent in the compulsory toner consumption mode under different calculation conditions between the image formation and the compulsory toner consumption mode.

20. The image formation device as claimed in claim 19, further comprising:

a transfer unit that transfers an image formed on the latent image carrier to a target transfer object;

a cleaning unit that removes and collects the developing agent on the latent image carrier;

a toner collection calculation unit that calculates an amount of the toner removed and collected by the cleaning unit; and a second compulsory toner consumption mode execution unit configured to execute a second compulsory toner consumption mode in which a developing bias different from the developing bias used during image formation is applied for the predetermined time period to discharge the residual developing agent on the developing agent carrier to the latent image carrier, and the developing agent on the latent image carrier is removed by the cleaning unit without being transferred to the transfer unit, wherein the toner consumption calculation unit and the second compulsory toner consumption mode execution unit calculate the amount of the developing agent removed and collected by the cleaning unit during the image formation and in the second compulsory toner consumption mode under different calculation conditions between the image formation and the second compulsory toner consumption mode.

* * * * *